US011114007B2

(12) United States Patent
Chang et al.

(10) Patent No.: US 11,114,007 B2
(45) Date of Patent: Sep. 7, 2021

(54) DISPLAY PANEL FOR PRECHARGING ACCORDING TO DATA SIGNAL AND DISPLAY PANEL DRIVING METHOD THEREOF

(71) Applicant: AU Optronics Corporation, Hsin-Chu (TW)

(72) Inventors: Chun-Wei Chang, Hsin-Chu (TW); Jie-Chuan Huang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/808,444

(22) Filed: Mar. 4, 2020

(65) Prior Publication Data

US 2020/0327836 A1 Oct. 15, 2020

(30) Foreign Application Priority Data

Apr. 9, 2019 (TW) ..... 108112372

(51) Int. Cl.
*G09G 3/34* (2006.01)
*G09G 3/20* (2006.01)

(52) U.S. Cl.
CPC ..... *G09G 3/20* (2013.01); *G09G 2300/0852* (2013.01); *G09G 2310/0291* (2013.01); *G09G 2310/0297* (2013.01); *G09G 2310/06* (2013.01); *G09G 2310/066* (2013.01); *G09G 2360/18* (2013.01); *G09G 2370/08* (2013.01)

(58) Field of Classification Search
CPC ..... G09G 3/20; G09G 2310/0291; G09G 2310/0297; G09G 2300/0852; G09G 2310/06; G09G 2310/066; G09G 2360/18; G09G 2370/08
See application file for complete search history.

(56) References Cited

U.S. PATENT DOCUMENTS 8,654,112 B2 * 2/2014 Hsu ..... G09G 3/3611 345/211
9,142,181 B2 * 9/2015 Kuo ..... G09G 3/3688
2006/0232539 A1 * 10/2006 Hashimoto ..... G09G 3/3688 345/96

(Continued)

FOREIGN PATENT DOCUMENTS

GN 107665692 A 2/2018
TW 200701147 A 1/2007

(Continued)

*Primary Examiner* — Adam J Snyder
(74) *Attorney, Agent, or Firm* — WPAT, PC

(57) ABSTRACT

A display panel includes multiple data lines, a scan lines, pixel circuit and a driving circuit. The data lines are configured to receive multiple data signals in a display period. There is a buffer period before the display period. The scan line is configured to receive a scan signal during the display period. The pixel circuit is electrically connected to the data lines and the scan line for receiving the data signals and the scan signal. The driving circuit is electrically connected to the data line, and configured to receive multiple charging signals during the buffer period. The charging signals are corresponding to the data lines and gradually increase so that the driving circuit charges the data lines according to the charging signals.

10 Claims, 6 Drawing Sheets

(56) References Cited

U.S. PATENT DOCUMENTS

| | | | | |
|---|---|---|---|---|
| 2006/0290637 | A1* | 12/2006 | Kang | G09G 3/3688 345/98 |
| 2008/0136810 | A1* | 6/2008 | Itakura | G09G 3/3648 345/215 |
| 2017/0309217 | A1 | 10/2017 | Kim et al. | |
| 2017/0345374 | A1 | 11/2017 | Chen et al. | |

FOREIGN PATENT DOCUMENTS

| | | | |
|---|---|---|---|
| TW | 201810223 | A | 3/2018 |
| TW | I680394 | B | 12/2019 |

* cited by examiner

DISPLAY PANEL FOR PRECHARGING ACCORDING TO DATA SIGNAL AND DISPLAY PANEL DRIVING METHOD THEREOF

CROSS-REFERENCE TO RELATED APPLICATION

This application claims priority to Taiwan Application Serial Number 108112372, filed Apr. 9, 2019, which is herein incorporated by reference in its entirety.

BACKGROUND

Technical Field

The present disclosure relates to a display panel configured to charge a pixel circuit according to a data signal to display the corresponding screen.

Description of Related Art

Flat panel displays have become the most popular display device because of their high-quality image display capabilities and low power consumption. Generally speaking, the pixel circuit in the display panel can adjust the luminous intensity or light transmittance according to different voltage levels to display the corresponding screen. Therefore, the charging and driving method of the pixel circuit will have the most direct impact on the display quality of the display panel.

SUMMARY

One aspect of the present disclosure is a display panel, including multiple data lines, a scan line, multiple pixel circuits and a driving circuit. The data lines are configured to receive multiple data signals during a display period. A buffer period before the display period. The scan line is configured to receive a scan signal during the display period. The pixel circuits are electrically connected to multiple data lines and the scan line, and configured to receive the data signals and the scan signal. The driving circuit is electrically connected to the data lines. The driving circuit is configured to receive multiple charging signals during the buffer period. The charging signals are corresponding to the data lines, and gradually increase so that the driving circuit charges the data lines according to the charging signals.

Another aspect of the present disclosure is a display panel, including multiple data lines, a scan line, multiple pixel circuits and a driving circuit. The data lines are configured to receive multiple data signals during a display period. A buffer period before the display period. The scan line is configured to receive a scan signal during the display period. The pixel circuits are electrically connected to the data lines and the scan line, and configured to receive the data signals and the scan signal. The driving circuit is electrically connected to the data lines. The driving circuit is configured to receive multiple charging signals during the buffer period, the charging signals are corresponding to the data lines. A voltage level of the charging signals is equal to a voltage level of the data signals, so that the driving circuit charges the data lines according to the charging signals during the buffer period.

Another aspect of the present disclosure is a display panel driving method, including: receiving a data signal during a buffer period by a processor; generating a charging signal according to the data signal during the buffer period, wherein the charging signal gradually increases; transmitting the charging signal to a data line of a display panel during the buffer period; and transmitting the data signal to the data line during a display period.

Accordingly, since the display panel charges the data lines in advance during the buffer period, the display panel will not cause noise during the display period due to the drastic change in the voltage level of the data lines, so it can ensure the performance of the display panel.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

For the embodiment below is described in detail with the accompanying drawings, embodiments are not provided to limit the scope of the present disclosure. Moreover, the operation of the described structure is not for limiting the order of implementation. Any device with equivalent functions that is produced from a structure formed by a recombination of elements is all covered by the scope of the present disclosure. Drawings are for the purpose of illustration only, and not plotted in accordance with the original size.

It will be understood that when an element is referred to as being "connected to" or "coupled to", it can be directly connected or coupled to the other element or intervening elements may be present. In contrast, when an element to another element is referred to as being "directly connected" or "directly coupled," there are no intervening elements present. As used herein, the term "and/or" includes an associated listed items or any and all combinations of more.

Figure 1:
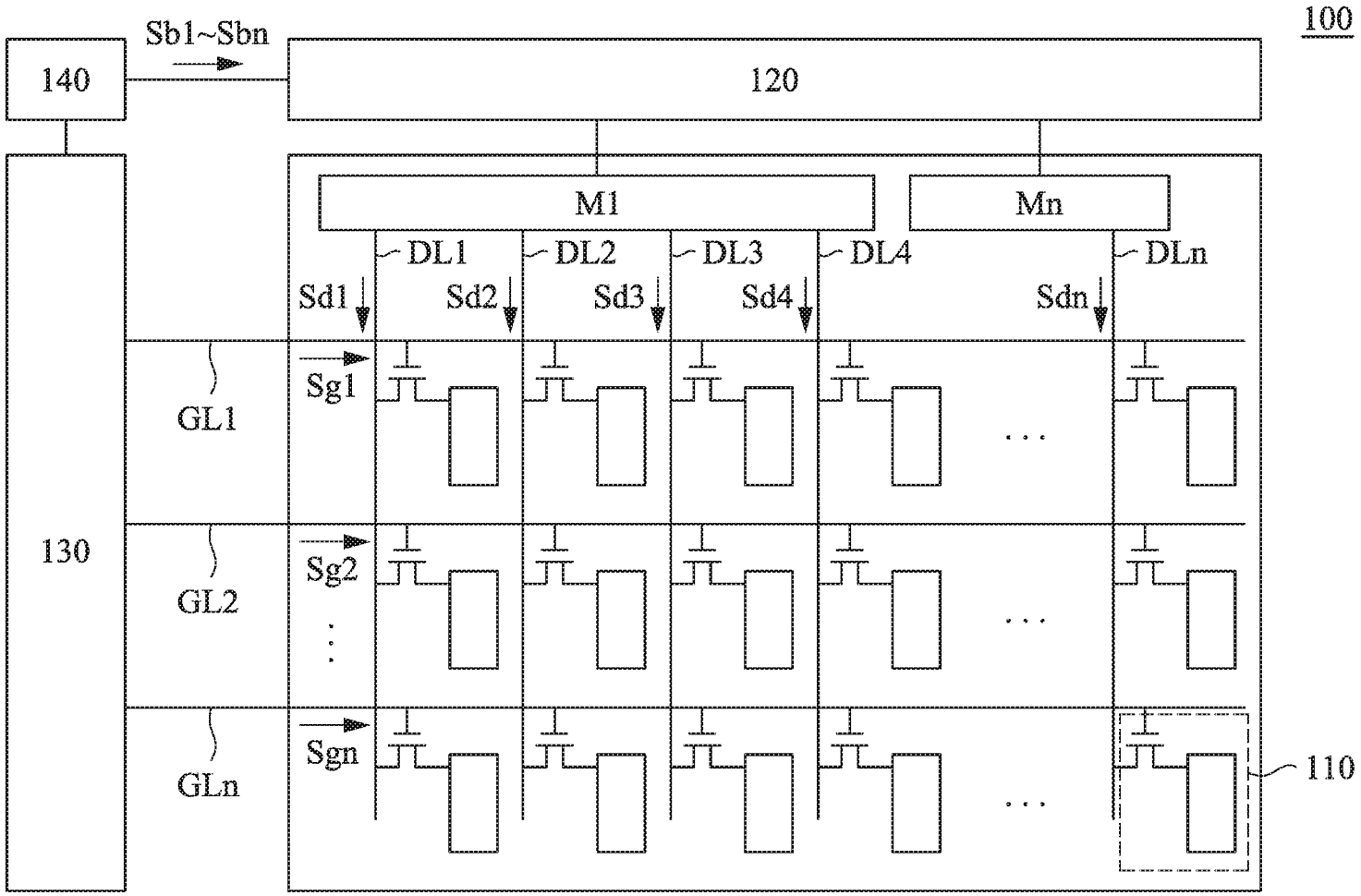
FIG. 1 is a schematic diagram of a display panel in some embodiments of the present disclosure.

Referring to the FIG. 1, the present disclosure relates to a display panel 100, including multiple data lines DL1-DLn, multiple scan lines GL1-GLn, multiple pixel circuits 110 and a driving circuit 120. The data lines DL1-DLn are configured to receive multiple data signals Sd1-Sdn. The scan lines GL1-GLn are configured to receive multiple scan signals Sg1-Sgn. The pixel circuits 110 are electrically connected the data lines DL1-DLn and the scan lines GL1-GLn to receive the data signals Sd1-Sdn and the scan signals Sg1-Sgn. The scan signals Sg1-Sgn are configured to turn on transistor switches in the pixel circuits 110, the data signals Sd1-Sdn are configured to charge capacitors in the pixel circuit 110, so that the pixel circuit 110 can display the corresponding colors. One of ordinary skill in the art can understand the structure of the pixel circuit 110, and thus they are not further detailed herein.

Figure 2:
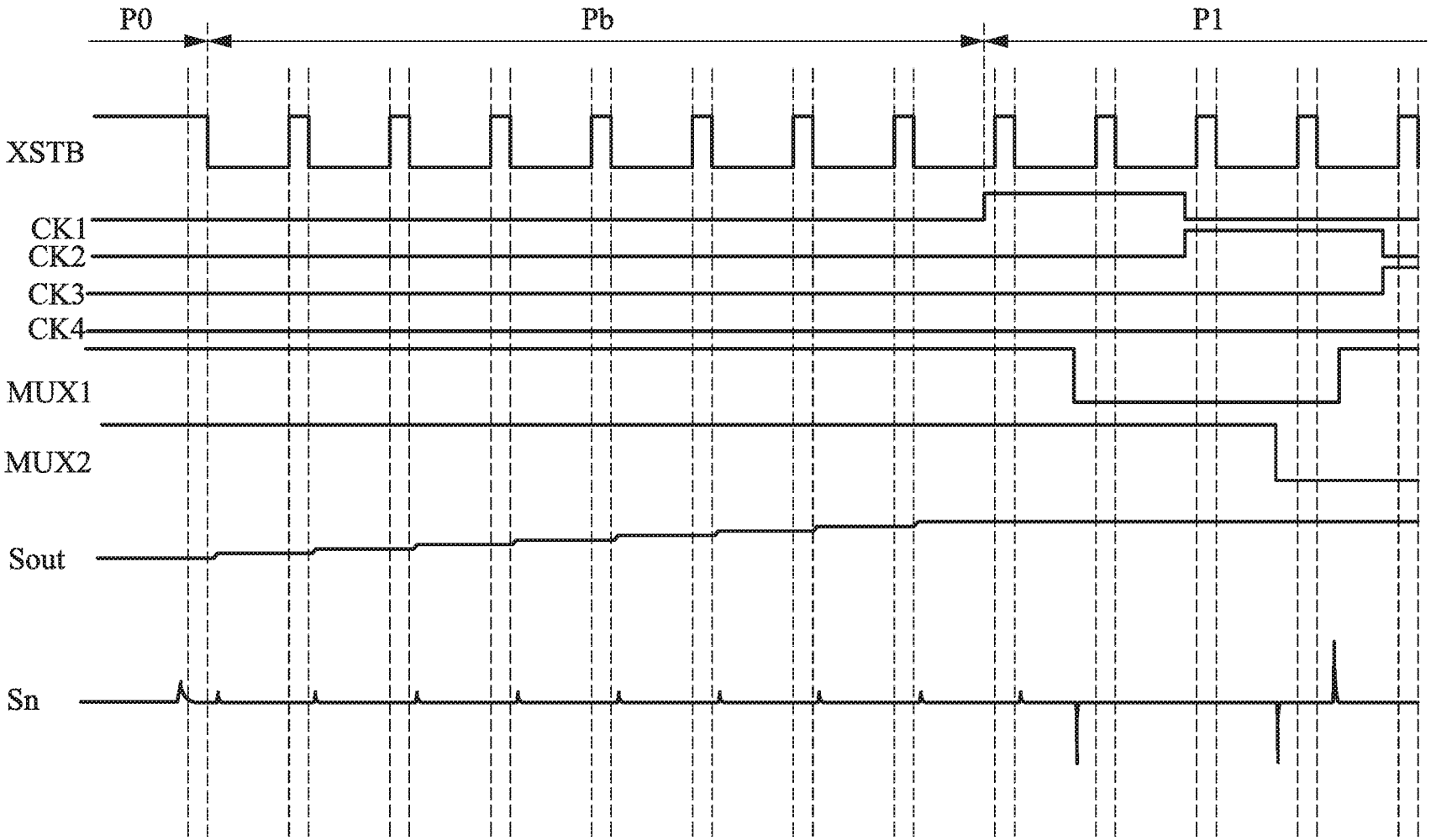
FIG. 2 is a waveform diagram of signals of the display panel in some embodiments of the present disclosure.

In some embodiments, the driving circuit 120 may be implemented in or implemented by a source driver, which is configured to transmit the data signals Sd1-Sdn to the data lines DL1-DLn. FIG. 2 is a waveform diagram of signals of the display panel in some embodiments of the present disclosure. The working operations of the display panel 100 include a display period and a buffer period. During the display period, the pixel circuit 110 displays the corresponding colors according to the data signals Sd1-Sdn and the scan signals Sg1-Sgn to generate each frame, as shown in the display period P0, P1 in FIG. 2. The buffer period (or blanking time) is between the display periods, as shown the buffer period Pb in FIG. 2. Previously the display panel does not apply voltage to the data lines DL1-DLn in the buffer period Pb.

As shown in FIG. 1 and FIG. 2, the driving circuit 120 is electrically connected the data lines DL1-DLn. During the buffer period Pb, the driving circuit 120 is configured to receive multiple charging signals Sb1-Sbn transmitted by the processor 140. The charging signals Sb1-Sbn correspond to the data lines DL1-DLn, and the voltage level of charging signals Sb1-Sbn gradually increases, so that the driving circuit 120 charges the data lines DL1-DLn according to the charging signals Sb1-Sbn. As shown in FIG. 2, Sout shows the voltage level on one of the data lines. Take the first data line DL1 as an example, the charging signal Sb1 increases step by step during the buffer period Pb. The voltage level of the first data line DL1 Sout will increase from zero, and when the buffer period PB is about to end, the voltage Sout will increase to the same voltage level as the first the data signal Sd1. The voltage level of each of the data lines DL1-DLn gradually increase, FIG. 2 only shows one of the waveform of voltage level Sout as an illustration.

In some embodiments, the display panel 100 includes at least two substrates, the pixel circuit 110 and the touch circuit (not shown in Figure) are arranged on the substrates. The touch circuit corresponds to the pixel circuit 110, and includes multiple touch electrodes, which are configured to detect the touch track or fingerprint of the user. One of ordinary skill in the art can understand the circuit structure and principle of touch circuit, and thus they are not further detailed herein.

In some embodiments, the display panel 100 is a Low Temperature Poly-silicon (LTPS) display, but it is not limited to this. When the display panel 100 with touch function, since the touch circuit of the display panel 100 performs touch detection at a specific time, so the driving voltage of the pixel circuit 110 may cause noise to the touch circuit and interfere with the accuracy of the touch. For example, when the pixel circuit 110 enters the display period P1, if the charging signal Sb1-Sbn is not charged gradually, the voltage level Sout on the data lines DL1-DLn will generate an excessive voltage difference in a short time, which will cause interference to the touch circuit.

As mentioned above, by pre-charging the data lines DL1-DLn during the buffer period Pb, the data signals Sd1-Sdn can be prevented from rising significantly in the display period P1, and the problem of noise due to voltage difference can be prevented (as shown in FIG. 2, voltage level Sout will not cause excessive noise Sn). During the buffer period Pb, the scan lines GL1-GLn do not transmit the scan signals Sg1-Sgn to the pixel circuit 110. Therefore, the transistor switches in the pixel circuit 110 will not be turned on, and the frame displayed by the display panel 100 will not be wrong.

In some embodiments, the display panel 100 is arranged on a display device (e.g., touch screen). The display panel 100 further includes a gate driver 130 and a processor 140. The processor 140 transmits the data signals Sd1-Sdn to the driving circuit 120 (or a source driver), then charges the pixel circuit 110 through the driving circuit 120 and the data lines DL1-DLn. Similarly, the processor 140 transmits the scan signals Sg1-Sgn to the gate driver 130, then control the transistor switches in the pixel circuit 110 to turn on or off through the gate driver 130 and the scan lines GL1-GLn.

Referring to the FIG. 2, in some embodiments, the driving circuit 120 is configured to control the voltage level Sout of the data lines DL1-DLn gradually increase. As shown in FIG. 2, the voltage level Sout (corresponding to the charging signal Sb1) is a step signal. Alternatively stated, the voltage level Sout will increase step by step. In some other embodiments, the processor 140 further provides the control signal XSTB to the driving circuit 120. The control signal XSTB includes multiple pulse signals. During the buffer period Pb, the driving circuit 120 controls the voltage level Sout of the data lines DL1-DLn gradually increase according to rise or fall of the pulse signals of the control signal XSTB, so that the voltage level Sout shows a stepped voltage change.

In some embodiments, the display panel 100 further includes multiple multiplexers M1-Mn. The driving circuit 120 is electrically connected to the data lines DL1-DLn through the multiplexers M1-Mn. During the display period P0, P1, the processor 140 will provide the clock signals CK1, CK2, CK3, CK4 and the multiplex signals MUX1, MUX2, so that the multiplexers M1-Mn switches according to the clock signals CK1-CK4 to transmit the received data signals Sd1-Sdn to the correct one of the data lines DL1-DLn. For example, in some embodiments, one of the multiplexers M1-Mn will corresponds four of the data lines. During the display period P1, the clock signals CK1-CK4 will be raised to the enable level in order to transmit the data signals Sd1-Sd4. One of ordinary skill in the art can understand the circuit structure and the principle of the multiplexer M1-Mn, and thus they are not further detailed herein.

For convenience of explaining the operation of the present disclosure, the detail structural features of the display panel 100 are described here as follows. The processor 140 includes a processing circuit 141 and multiple registers b1-b7 (seven in this embodiment). The processing circuit 141 is configured to generate the data signals Sd1-Sdn according to an image signal eDP. In some embodiments, the image signal eDP can be pixel data of one frame. Each of the data signals Sd1-Sdn respectively corresponds to each column of the pixel circuits 110 of the display panel 100. The processing circuit 141 stores the data signals Sd1-Sdn by the registers, after every register b1-b7 has already stored the corresponding data signals Sd1-Sdn, the processing circuit 141 transmits the data signal Sd1-Sdn stored in the register b1-b7 to the driving circuit 120 through a latch 121 and a register b8.

For example, the processing circuit 141 generates a first data signal Sd1 according to a first image signal eDP, and stores the first data signal Sd1 to the register b1. Then, when the processing circuit 141 receive a new image signal eDP, the processing circuit 141 transmits the first data signal Sd1 to the register b2, then generates the second data signal Sd2 according to the new image signal eDP, and stores the new image signal eDP to the register b1. After every register b1-bn has already stored the corresponding data signals Sd1-Sdn, the processing circuit 141 transmits the data signals Sd1-Sdn to the driving circuit 120.

Figure 3:
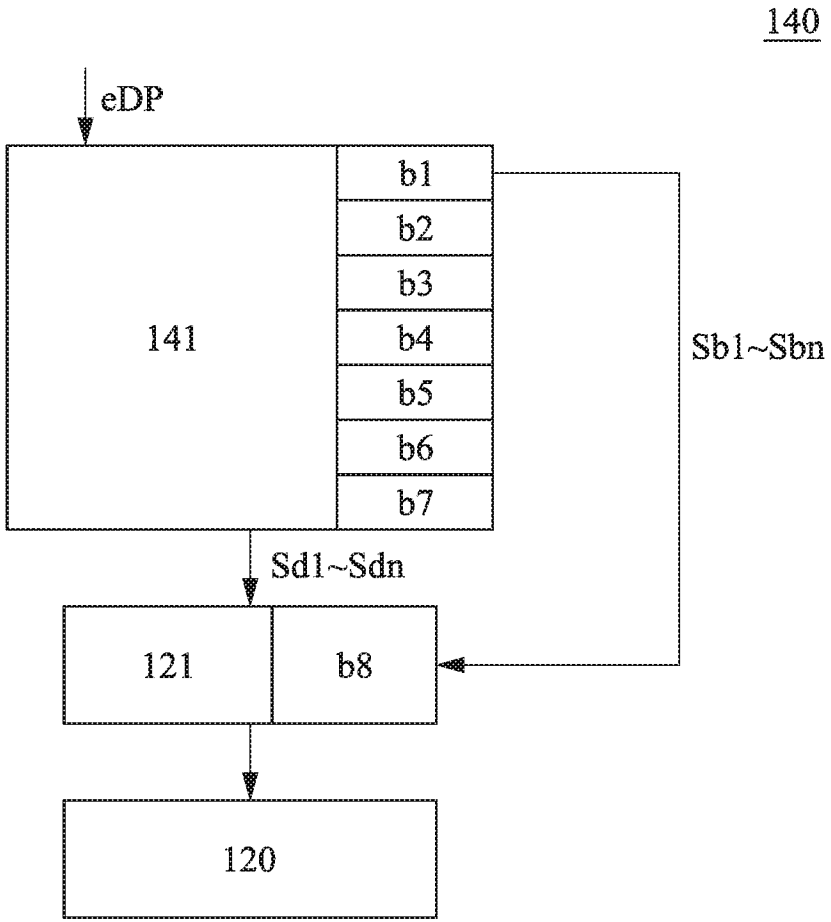
FIG. 3 is a schematic diagram of the processor and driving circuit in some embodiments of the present disclosure.

Referring to the FIG. 3, in addition to transmitting the data signals Sd1-Sdn through the registers b1-bn, the processor 140 can also process the received data signal Sd1-Sdn at the same time to generate the charging signals Sb1-Sbn. Each of the charging signals Sb1-Sbn corresponds to each of the data lines DL1-DLn. After the register b1 receives the data signals Sd1-Sdn, the processing circuit 141 generate the corresponding charging signals Sb1-Sbn at the same time, and transmits the corresponding charging signals Sb1-Sbn to the driving circuit 120. The charging signals Sb1-Sbn will increase gradually from the reference voltage (e.g., zero or a low level). Before the end of the buffer period Pb, The charging signals Sb1-Sbn rise to the voltage level corresponding to the data signal Sd1-Sdn.

Referring to FIG. 1 to FIG. 3, when the display panel 100 drives the pixel circuits 110 in the first row, noise problems often occur at this time. Therefore, in some embodiments, the processor 140 generates the charging signals Sb1-Sbn according to the data signal Sd1-Sdn (e.g., corresponding to the first scan line GL1) of the pixel circuits 110 in the first row.

In some embodiments, the charging signals Sb1-Sbn increase step by step according to interpolation. For example, at the beginning of the buffer period Pb, the voltage level on the data lines DL1-Dn is maintained at the reference voltage (e.g., the voltage level corresponding to the gray level value "0", and the data signal Sd1 is the voltage level corresponding to the grayscale value "255". As shown in FIG. 3, the processor 140 has seven registers b1-b7. Therefore, during the buffer period Pb, the control signal XSTB will have seven pulses. Because the driving circuit 120 also includes a register b8, the charging signal should increase by "(255−0)/(7+1)=31.875" each time. That is, each time one pulse in the control signal XSTB is passed, the processor 140 increases the voltage level of the charging signal Sb1, which is corresponding to a grayscale value of "32".

In addition, in some embodiments, the driving circuit 120 stores a minimum rising value. If the value of the charging signals should increase each time is too small (e.g., less than 1), the driving circuit 120 will generate the charging signal Sb1-Sbn according to the minimum rising value (e.g., sets any positive integer as the charging signal, or sets the data signal as the charging signal). However, the driving circuit 120 will ensure that the charging signals does not exceed the voltage level corresponding to the data signal Sd1.

In the mentioned embodiments, the charging signals Sb1-Sb7 increase gradually during the buffer period Pb. In some other embodiments, the driving circuit 120 can directly receive the charging signals Sb1-Sb7 at the same voltage level of the data signals Sd1-Sdn during the buffer period Pb. Referring to the FIG. 4, in this embodiment, the driving circuit 120 receives the charging signals Sb1-Sb7 which is the same as the voltage level of the data signals Sd1-Sdn during the buffer period Pb in advance. As shown in the voltage level Sout of FIG. 4, the driving circuit 120 can transmit the charging signals Sb1-Sbn according to one of the pulse in the control signal XSTB, so that the voltage level Sout of the data lines DL1-DLn rises in advance to the voltage level corresponding to the data signals Sd1-Sdn. Accordingly, the noise problem caused by the display panel 100 during the display period P1 due to the excessive voltage difference in the data lines DL1-DLn in a short time can be avoided.

Figure 4:
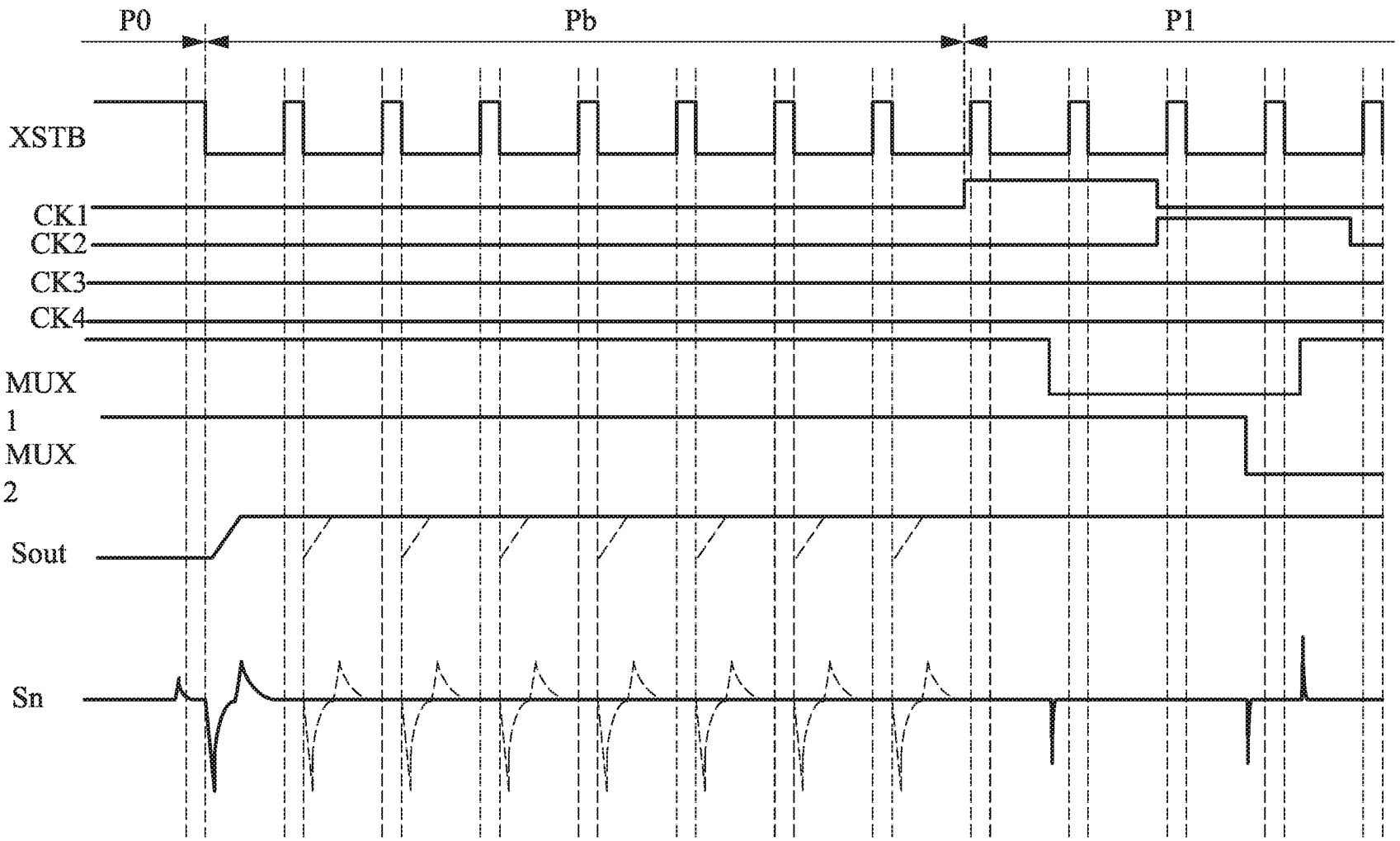
FIG. 4 is a waveform diagram of signals of the display panel in some embodiments of the present disclosure.

As mentioned above, for example, during the buffer period Pb, the voltage level of the charging signal Sb1 received by the driving circuit 120 is equal to the voltage level of the data signal Sd1. Similarly, the voltage level of the charging signal Sb2 is equal to the voltage level of the data signal Sd2. FIG. 4 only shows a waveform of one of the data lines DL1-DLn with Sout. As shown in FIG. 4, voltage level Sout does not generate excessive noise Sn during the display period P1.

Figure 5:
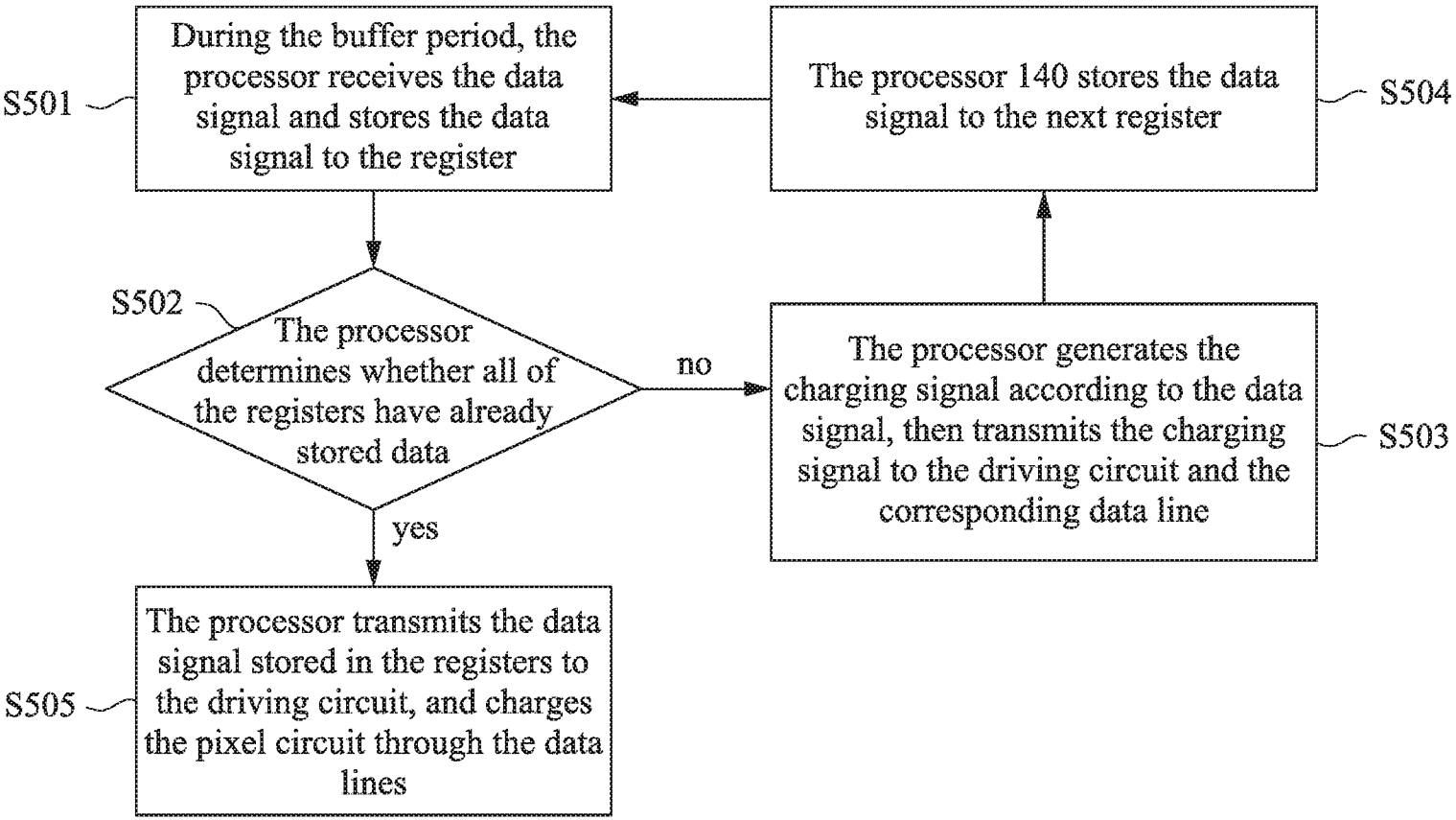
FIG. 5 is a flowchart of display panel driving method in some embodiments of the present disclosure.

For convenience of explaining the driving method of the present disclosure, the following describes the driving method of the display panel 100. Referring to the FIG. 5, in step S501, when the display period P0 ends to enter the buffer period Pb, the processor 140 receives a first data signal Sd1 (or generate the first data signal Sd1 according to the image signal eDP), and stores the first data signal Sd1 to a first register b1. In step S502, during the buffer period Pb, the processing circuit 141 determines whether all of the registers b1-b7 of the processor 140 have already stored data (i.e., receive multiple data signals Sd1-Sdn). If all of the registers b1-b7 have already stored the data signals Sd1-Sdn, entering the step S505, charging the pixel circuits 110 according to the data signals Sd1-Sdn stored in the register b1-b7.

On the other hand, if the registers b1-b7 have not stored the corresponding data signals Sd1-Sdn, then entering the step S503. In step S503, the processing circuit 141 of the processor 140 generates a first charging signal Sb1 according to the first data signal Sd1, then transmits the first charging signal Sb1 to the driving circuit 120 and the corresponding data line DL1 through the register b8. In some embodiments, the processing circuit 141 can calculate the first charging signal Sb1 according to a pre-stored table in the processor 140, or according to interpolation. The charging signal Sb1 gradually increase to the voltage level of the corresponding first data signal Sd1 (as shown in FIG. 2). In some other embodiments, the charging signal Sb1 may be directly equal to the voltage level of the first data signal Sd1 (as shown in FIG. 4).

In step S504, the processor 140 stores the data signal Sd1 to a second register b2, then returns to the step S501 to receive a new data signal Sd2. After the registers b1-b7 of the processor 140 have already stored data (i.e., already receive multiple data signals Sd1-Sdn), in the step S505, the processor 140 transmits the data signal Sd1-Sdn stored in the registers b1-b7 to the driving circuit 120, and charges the pixel circuit 110 through the data lines DL1-DLn.

Figure 6:
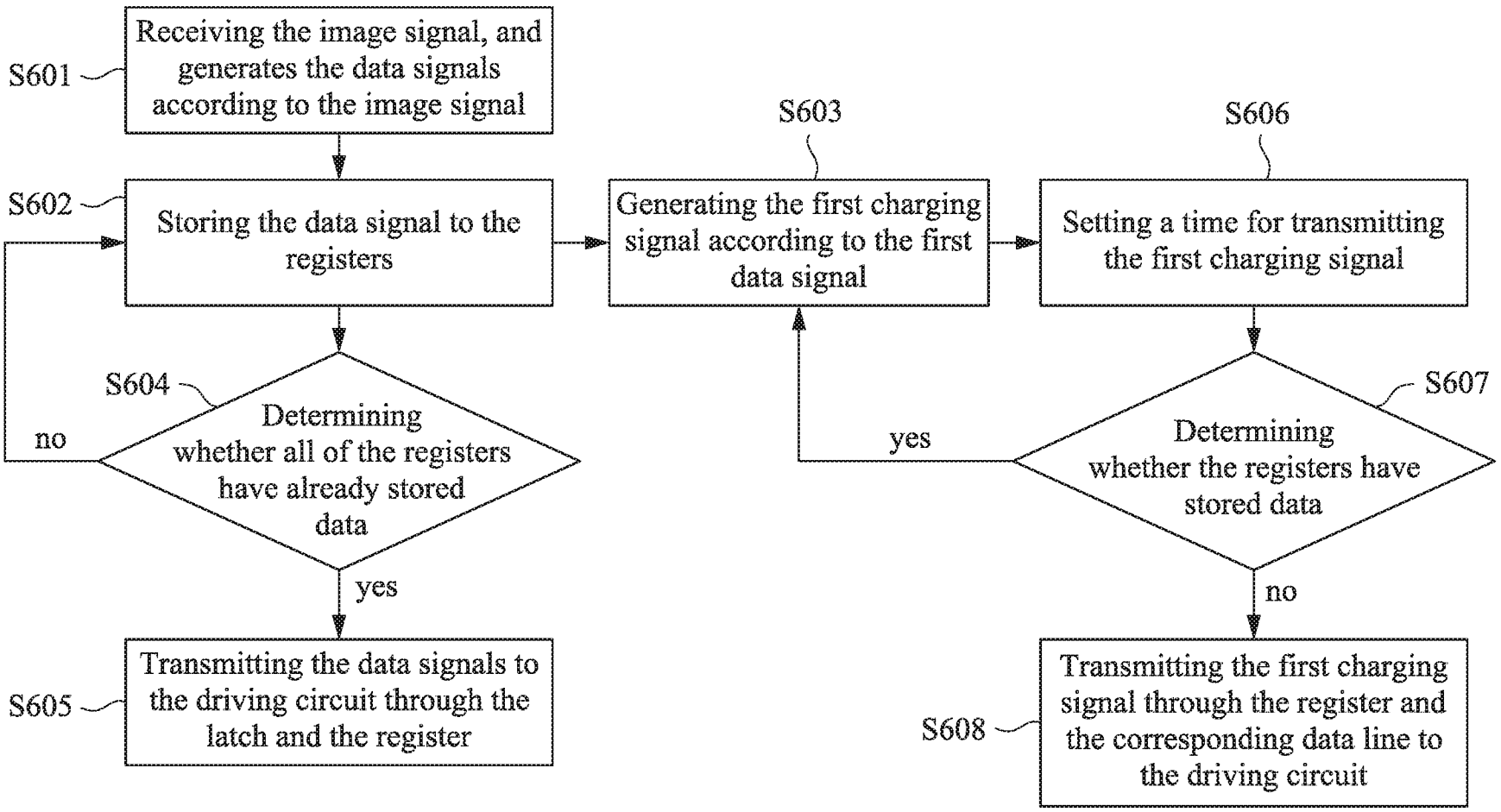
FIG. 6 is a flowchart of display panel driving method in some embodiments of the present disclosure.

Referring to the FIG. 3 and FIG. 6, FIG. 6 is a flowchart of display panel driving method in some embodiments of the present disclosure. In step S601, the processing circuit 141 of the processor 140 receives the image signal eDP, and generates the data signals Sd1-Sdn according to the image signal eDP. In step S602, the processing circuit 141 stores the data signal Sd1-Sdn to the registers b1-b7.

After storing the data signals Sd1-Sdn to the registers b1-b7, the processing circuit 141 performs the steps S603 and S604, respectively. In step S603, the processing circuit 141 of the processor 140 generates the first charging signal Sb1 according to the first data signal Sd1 (e.g., the mentioned interpolation). In step S604, the processor 140 determines whether all of the registers b1-b7 have already stored data?

If all of the registers b1-b7 have already stored data, in the step S605, the processing circuit 141 transmits the data signals Sd1-Sdn stored in the registers b1-b7 to the driving circuit 120 through the latch 121 and the register b8. If the registers b1-b7 have not all already stored data, the processor 140 will return to the step S602 to store other data signals.

On the other hand, after generating the first charging signal Sb1, in the step S606, the processor 140 is further configured to set a time for transmitting the first charging signal Sb1. In the step S607, the processor 140 determines whether the registers b1-b7 have stored data? If all of the registers b1-b7 already have data stored, it means that the foregoing step S605 can be performed to transmit the data signals Sd1-Sdn. Therefore, the processor 140 will not need to transmit the first charging signal Sb1 at this time. At this time, the processing circuit 141 will wait to generate the other first charging signal according to the other first data signal Sd1 of the next frame.

If the registers b1-b7 does not all store data at this time, then in step S608, the processor 140 transmits the first charging signal Sb1 through the register b8 and the corresponding data line DL1 to the driving circuit 120.

The elements, method steps, or technical features in the foregoing embodiments may be combined with each other, and are not limited to the order of the specification description or the order of the drawings in the present disclosure.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A display panel, comprising:

a plurality of data lines configured to receive a plurality of data signals during a display period, wherein a buffer period before the display period;

a scan line configured to receive a scan signal during the display period;

a plurality of pixel circuits electrically connected to the plurality of data lines and the scan line, and configured to receive the plurality of data signals and the scan signal;

a driving circuit electrically connected to the plurality of data lines, wherein the driving circuit is configured to receive a plurality of charging signals during the buffer period, the plurality of charging signals are corresponding to the plurality of data lines, and gradually increase so that the driving circuit charges the plurality of data lines according to the plurality of charging signals, and a voltage level of the plurality of data lines is increased to equal a voltage level of the plurality of data signals before the end of the buffer period; and a processor comprising a plurality of registers and electrically connected to the driving circuit, wherein the plurality of registers receive the plurality of data signals during the buffer period, so that the processor processes the plurality of data signals stored by the plurality of registers to generate and transmit the plurality of charging signals to the driving circuit during the buffer period.

2. The display panel of claim 1, wherein a voltage level of the plurality of charging signals is increased from a reference voltage to the voltage level of the corresponding data signals.

3. The display panel of claim 1, wherein the plurality of charging signals increase step by step.

4. The display panel of claim 1, further comprising a multiplexer, wherein the driving circuit is electrically connected to the plurality of data lines through the multiplexer.

5. A display panel, comprising:

a plurality of data lines configured to receive a plurality of data signals during a display period, wherein a buffer period before the display period;

a scan line configured to receive a scan signal during the display period;

a plurality of pixel circuits electrically connected to the plurality of data lines and the scan line, and configured to receive the plurality of data signals and the scan signal;

a driving circuit electrically connected to the plurality of data lines, wherein the driving circuit is configured to receive a plurality of charging signals during the buffer period, the plurality of charging signals are corresponding to the plurality of data lines, and a voltage level of the plurality of charging signals is equal to a voltage level of the plurality of data signals, so that the driving circuit charges the plurality of data lines according to the plurality of charging signals during the buffer period; and a processor comprising a plurality of registers and electrically connected to the driving circuit, wherein the plurality of registers receive the plurality of data signals during the buffer period, so that the processor processes the plurality of data signals stored by the plurality of registers to generate and transmit the plurality of charging signals to the driving circuit during the buffer period.

6. The display panel of claim 5, further comprising a multiplexer, wherein the driving circuit is electrically connected to the plurality of data lines through the multiplexer.

7. A display panel driving method, comprising:

receiving a data signal during a buffer period by one of a plurality of registers comprised by a processor;

processing the data signal stored by the one of the plurality of registers to generate and transmit a charging signal to a driving circuit during the buffer period by the processor, wherein the charging signal gradually increases;

transmitting the charging signal to a data line of a display panel during the buffer period by the driving circuit;

increasing a voltage level of the data line to equal a voltage level of the data signal before the end of the buffer period by the driving circuit; and transmitting the data signal to the data line during a display period by the driving circuit.

8. The display panel driving method of claim 7, further comprising:

increasing a voltage level of the charging signal from a reference voltage to the voltage level of the corresponding data signals by the processor.

9. The display panel driving method of claim 7, further comprising:

storing the data signal to the one of the plurality of registers during the buffer period;

determining whether all of the plurality of registers has already stored data; and generating the charging signal according to the data signal when all of the plurality of registers already store data.

10. The display panel driving method of claim 9, further comprising:

transmitting the data stored in the plurality of registers to a driving circuit of the display panel when all of the plurality of registers already store data.

* * * * *